106-97 AU 115 EX
9/29/87 XR 4,697,063

United States Patent [19]

Germundson

[11] Patent Number: 4,697,063

[45] Date of Patent: Sep. 29, 1987

[54] ELECTRIC HEATING ELEMENT

[75] Inventor: Lars Germundson, Göteborg, Sweden

[73] Assignee: L G Innovations AB, Vastra Frolunda, Sweden

[21] Appl. No.: 856,351

[22] Filed: Apr. 28, 1986

[30] Foreign Application Priority Data

May 7, 1985 [SE] Sweden ..... 8502235

[51] Int. Cl.[4] ..... H05B 3/28

[52] U.S. Cl. ..... 219/213; 106/76; 106/97; 219/345; 219/553

[58] Field of Search ..... 219/213, 345, 544, 548, 219/553; 106/76, 97

[56] References Cited

U.S. PATENT DOCUMENTS

| | | | |
|---|---|---|---|
| 802,914 | 10/1905 | Christensen | 106/75 |
| 3,412,358 | 11/1968 | Hummel | 219/528 |

FOREIGN PATENT DOCUMENTS

| | | | |
|---|---|---|---|
| 2138155 | 2/1973 | Fed. Rep. of Germany . | |
| 1164285 | 9/1969 | United Kingdom | 219/345 |
| 1363428 | 8/1974 | United Kingdom | 219/213 |
| 1553497 | 9/1979 | United Kingdom | 219/548 |

*Primary Examiner*—E. A. Goldberg
*Assistant Examiner*—Teresa J. Walberg
*Attorney, Agent, or Firm*—Wegner & Bretschneider

[57] ABSTRACT

An electric heating element includes a core of electrically conductive material connected to a source of alternating current and has a shell of impermeable concrete. The core is moulded from a mixture of graphite powder, silicate of potassium, cement and water.

11 Claims, 4 Drawing Figures

ELECTRIC HEATING ELEMENT

This invention relates to an electric heating element comprising a core of electrically conductive material, which is connected to a source of alternating current and has a surrounding shell of impermeable concrete.

SUMMARY OF THE PRIOR ART

Electric heating elements manufactured by moulding carbon reinforced cement are known. The carbon fibres act like electrical conductors forming a resistor and also provide structural strength to the cement.

When these fibres are used, the current path within the element must be very long, in order to get sufficient resistance, without making the conductive properties unreliable. This long path of the current is formed during the moulding of the core by incorporation of electrically insulating strips, which are positioned between the terminals alternatively extending into the core from one side and then from the other, forming a continuing Z-shaped path.

The use of carbon fibres and the necessity for the creation of the long path of current, makes this product very expensive resulting in a small demand.

SUMMARY OF THE INVENTION

The object of the present invention is to provide an electric heating element, based on cement as the main ingredient, which is simple and economic to produce.

Thus the electric heating element according to the invention is characterized in that the core is moulded from a mixture comprising from 20 to 30 w.p. of graphite powder, from 35 to 45 w.p. of cement and sand in 1:3 proportions, from 25 to 35 w.p. of silicate of potassium and from 5 to 10 w.p. of water.

Preferably the length, breadth and thickness of the shell in relation to the core are as 1.25 to 1, 2 to 1 and 3.5 to 1, respectively. Further, the length and breadth of the core are related to its thickness as about 30 to 1 and 10 to 1, respectively.

The shell is preferably formed as a building element for use in houses, e.g. a floor plate or a window sill.

The invention will now be described in further detail, reference being made to the attached drawing.

DETAILED DESCRIPTION

Figure 1:
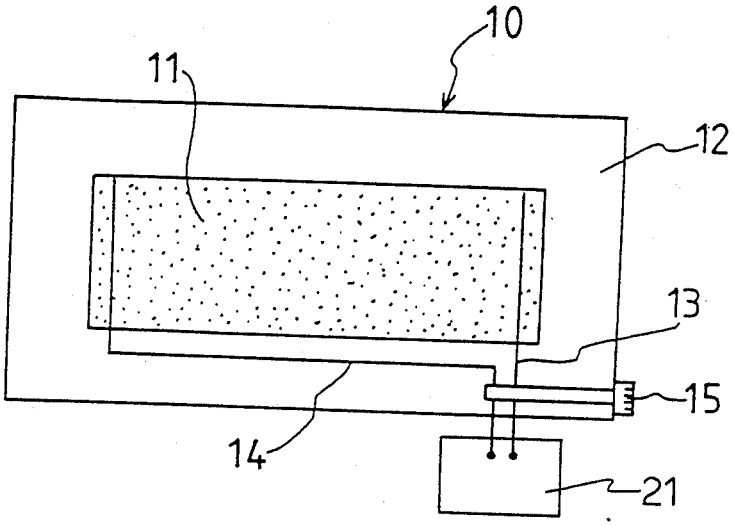
FIG. 1 is a longitudinal section through an element, such as a floor, according to the invention.

As shown in FIG. 1, the electric heating element 10 comprises a core 11 of electrically conductive cement, and a shell 12 of non-conductive, impermeable concrete. The core 11 is connected to a thermostat/contact breaker 15 via two copper conductors 13, 14 which are cemented into the core. The thermostat/contact breaker is connected to a source of alternating current, preferably a power supply network for 220 volt current.

The conductors 13, 14 are connected to a current or power source 21, such as a household electric outlet or a generator of a propelling engine. As shown in FIG. 1, the element 10 is a building element, such as a floor, which is for use in a building or a boat.

Figure 2:
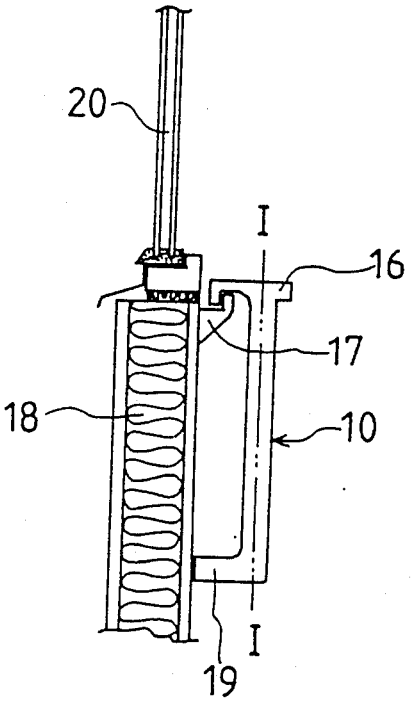
FIG. 2 is a cross section through a wall of a house having an element mounted below a window.

The shell, as shown in FIG. 2, can be shaped as a window sill, having a flat vertical section 16 which cooperates with a bracket 17, mounted on the wall 18. The shell further possesses a perpendicular section 19 which abuts the wall 18. This modular unit is simple to mount, e.g. as shown below a window 20 to provide a combination of window sill and radiator.

The core 11 is moulded from a mixture comprising from 35 to 45 w.p. of cement having a grain size from 0.01–0.016 mm and sand in 1:3 proportions, from 5 to 10 w.p. of water, from 20 to 30 w.p. graphite powder having a grain size smaller than 0.074 mm (200 mesh) and from 25 to 35 w.p. silicate of potassium or sodium, i.e. $SiO_2/Na_2O$ with 73 w.p. $SiO_2$ and 27 w.p. $Na_2O$. The internal resistance of the radiator core and therefore the maximal temperature can be increased or lowered through variation of the proportion of graphite powder within this mixture.

The cement must not contain ferrous sulphate ($FeSO_4$) and the pH-value must be around 13 in order to preclude the cement from immediately setting prior to being moulded. The pH-value of the silicate of potassium must be between 11.5–12.

An electric radiator according to the invention having a maximum possible temperature of 55° C. can be manufactured from a mixture having the following proportions (w.p. being percentage by weight):

39.18 w.p. of cement and sand in 1:3 proportions 5.96 w.p. of water 26.87 w.p. of graphite powder 27.99 w.p. of silicate of potassium or sodium, wherein this mixture is moulded into a plate for testing purposes having the following dimensions: breadth 75 millimeters, length 235 millimeters and thickness 7 millimeters.

A hole is drilled into this core plate 11 for the copper conductors 13, 14 near each of its short ends. Both conductors preferably are insulated, and this insulation is removed along a distance equal to the breadth of the plate. Then the stripped parts of the conductors are entered into the holes in the core and cemented in place by means of a mixture of silicate of potassium and graphite powder. The free ends of the conductors are then connected to the thermostat/contact breaker 15. The plate 11 together with conductors and thermostat is placed into a moulding bed, and normal water impermeable concrete is poured into the mould forming the shell. The dimensions of the shell are related to the dimensions of the core as follows: breadth 2:1, length 1.25:1 and thickness 3.5:1.

This electric radiator has a surface temperature of about 55° C. and consumes about 22 Wh. The temperature can be regulated to any desired level below said temperature by means of the thermostat 15 which cuts the current at the selected temperature. As the electric radiator according to the invention has a large mass, it will store heat energy, which will radiate to the surroundings while the thermostat is switched off. Thus the temperature can be kept nearly constant to reduce the cold draught from the window 20. This storage effect is lacking with conventional direct electrical radiators.

The electric radiator according to the invention can be moulded into various building elements, e.g. floor plates, steps for a stairway or benches for parks or sport arenas. As no part of the radiator gets warmer than 55° C., it is absolutely safe and will not hurt if it is touched by a person, and will not cause fire on nearby garments or curtains.

The radiators can be used as an accumulator of energy, e.g. in a pleasure boat, whereby the surplus energy from the generator of a propelling engine can be converted to heat which is stored within the radiators. When the propelling engine is stopped, the radiators can emit heat for several hours, depending on the size of the radiators.

Figure 3:
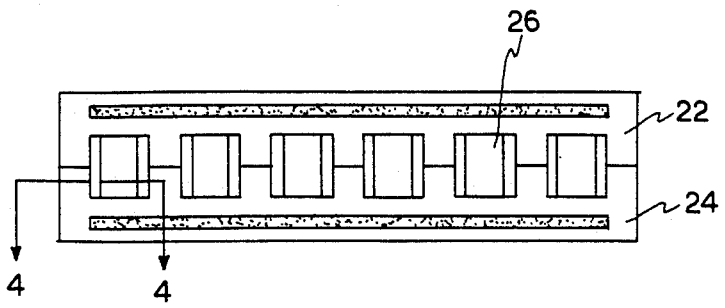
FIG. 3 is a top elevational view of the electric heating element showing a plurality of channels therein.
Figure 4:
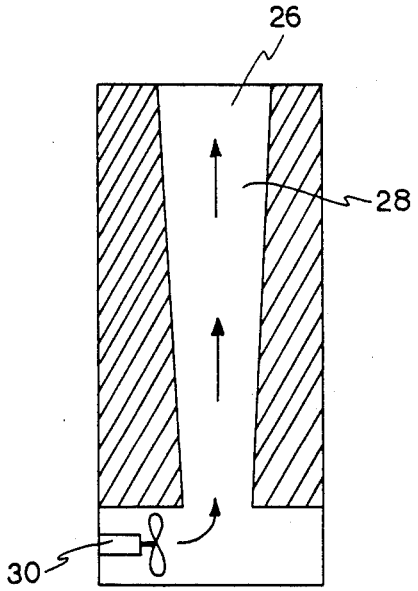
FIG. 4 is a cross-sectional view taken along line 4—4 of FIG. 3 showing the manner in which a fan is used to force air through at least one channel.

As shown in FIG. 3, the radiator according to the invention can comprise two individually moulded halves 22, 24, which cooperate to form a unit with internal, vertically arranged channels 26, preferably diverging upwards. As illustrated in FIG. 4, it is possible to force air (shown as arrows) upwards through the channel 26 by means of a small electric fan 30 mounted at the bottom of said unit. In this way the heating efficiency will be greatly increased.

The invention is not limited to the above described embodiment, but several variations are possible within the scope of the accompanying claims. For instance a heat resistant plastic film can be used as insulation between the core and the shell. The above described mixing proportions can be varied as well as the dimension of the radiator, e.g. for other voltages than 220 volt.

I claim:

1. An electric heating element, comprising:

a core of electrically conductive material, moulded from a mixture having:

between 20 to 30 percentage by weight of graphite powder, between 35 to 45 percentage by weight of cement and sand in 1:3 proportions, between 25 to 35 percentage by weight of silicate of potassium, and between 5 to 10 percentage by weight of water;

a surrounding shell of non-conductive and impermeable concrete;

conductors directly cemented into said core; and means for connecting said conductors to a source of alternating current.

2. The electric heating element according to claim 1, wherein the breadth, length and thickness of said shell in relation to the same dimensions of said core are as 1.25 to 1, 2.0 to 1 and 3.5 to 1, respectively.

3. The electric heating element according to claim 2, wherein the length and breadth of said core are related to its thickness as about 30 to 1 and 10 to 1, respectively.

4. The electric heating element according to claim 1, wherein said shell is formed as a building element for use in houses.

5. The electric heating element according to claim 4, wherein said building element is a floor.

6. The electric heating element according to claim 4, further comprising attaching means integral to said shell for mounting thereof.

7. The electric heating element according to claim 6, wherein said building element is a window sill.

8. The electric heating element according to claim 1, wherein said source of alternating current is a generator of a propelling engine.

9. The electric heating element according to claim 1, wherein said core comprises at least two moulded halves suitable for forming a plurality of channels therein.

10. The electric heating element according to claim 9, further comprising a fan means for forcing air through said channels.

11. The electric heating element according to claim 1, wherein said mixture of said core has a pH value of about 13 in order to preclude said mixture from immediately setting prior to being moulded.

* * * * *